US005934342A

United States Patent [19]

Danielson

[11] Patent Number: 5,934,342

[45] Date of Patent: Aug. 10, 1999

[54] HAND TOOL FOR WIRE TENSIONING

[76] Inventor: Charles A. Danielson, P.O. Box 127, Santa, Id. 83866

[21] Appl. No.: 08/934,862

[22] Filed: Sep. 22, 1997

Related U.S. Application Data

[63] Continuation-in-part of application No. 08/671,792, Jun. 24, 1996, abandoned.

[51] Int. Cl.[6] ..... B21F 9/00

[52] U.S. Cl. ..... 140/121; 7/117

[58] Field of Search ..... 140/102.5, 121, 140/123.5; 254/28; 7/117, 137

[56] References Cited

U.S. PATENT DOCUMENTS

| | | | |
|---|---|---|---|
| 591,689 | 10/1897 | Ponkney | 254/28 |
| 766,082 | 7/1904 | Watt | 7/137 |
| 885,816 | 4/1908 | Weyeneth | 7/117 |
| 1,044,551 | 11/1912 | Lynch . | |
| 1,174,267 | 3/1916 | Naffziger | 140/121 |
| 1,239,061 | 9/1917 | Tangen . | |
| 1,644,352 | 10/1927 | Perrin | 140/121 |
| 1,949,335 | 2/1934 | Settles | 254/28 |
| 2,124,416 | 7/1938 | Hadland | 140/123.5 |
| 2,313,530 | 3/1943 | Feigion | 140/121 |
| 2,399,139 | 4/1946 | Palola | 140/118 |
| 3,219,316 | 11/1965 | Fried | 254/131 |
| 3,229,727 | 1/1966 | Kenlon | 140/102.5 |
| 3,655,165 | 4/1972 | Wright | 254/77 |
| 3,768,779 | 10/1973 | Garretson | 254/51 |
| 4,614,001 | 9/1986 | Liou | 7/137 |

*Primary Examiner*—Lowell A. Larson

*Attorney, Agent, or Firm*—Ken J. Pedersen; Barbara S. Pedersen

[57] ABSTRACT

A hand tool combines jaws for gripping a wire with a spool for winding the wire so as to increase longitudinal tension in the wire prior to completing a splice. A method of the present invention for tensioning and splicing two wires includes the step of winding a wire around a spool while maintaining a grip on the wire between manually operated jaws until sufficient tension is established in the wires being joined. The hand tool and method provide splices with greater tension and lower risk of personal injury than possible with conventional tools and methods and are particularly appropriate for repairing electric and barbed wire fencing as used in ranching operations.

5 Claims, 2 Drawing Sheets

HAND TOOL FOR WIRE TENSIONING

DESCRIPTION

This application is a continuation-in-part of my prior, application, entitled "Hand Tool for Wire Tensioning", Ser. No. 08/671,792, filed Jun. 24, 1996, now abandoned hereby incorporated by reference.

BACKGROUND OF THE INVENTION

1. Field of the Invention

This invention relates to wire tensioning and splicing and to tools and methods for joining wires.

2. Background of the Invention

As an introduction to the problems solved by the present invention, consider conventional open range barbed wire fence repair. Steel wire fences are used frequently in agriculture for maintaining stock within designated areas. Working of the steel wire due to stock movement combined with weathering eventually lead to open fence lines where rusted wire has finally parted.

Conventional hand tools are used to effect repair between two wire ends formerly of one continuous strand. In one known method, wire cutting pliers are used to trim the ends back to solid material. Then one wire end is formed into a loop by twisting it back upon itself, using pliers to position the loop and to grip the wire end being twisted. The second wire end is then brought through the loop and grasped with the claw of a carpenter's claw hammer. The hammer with the second wire end in the claw is pulled until sufficient tension develops in both the first and second wire ends. The second wire is kinked at the loop to prevent its slipping back through the loop. Finally, pliers are again used to trim and wrap the second wire end back on itself to complete the splice.

Use of a hammer, and one or two pairs of pliers is awkward. When repair is to be done by one person arriving on the scene on horseback, considerable time is ordinarily required to obtain the tools from storage, arrange them within reach, and proceed with repair. Substantial strength and coordination are also required to properly tension the wire ends for "like-new" results after the splice is completed.

The waste and expense of injured, lost, mixed, or stolen stock due to untimely repair of broken fencing is apparent. Less obvious is the cost of inadequate repair caused by using inappropriate tools, broken tools, or by failing to use proper tools, adequate time, and adequate strength to effect repair in a fence line accessible only after several days on horseback across a large ranch. In addition, fence repair by conventional methods exposes the repairman to a high risk of personal injury resulting in unexpected interruption of services, further delay in repairs, and subsequent losses.

In view of the problems described above and related problems that consequently become apparent to those skilled in the applicable arts, the need remains in wire splicing and joining for an improved tool.

SUMMARY OF THE INVENTION

Accordingly, a hand tool for manipulating a wire in one embodiment of the present invention includes a first handpiece that pivots with a second handpiece. Each handpiece has a jaw. The jaws cooperate to grip the wire. The second handpiece also includes a spool for winding the wire thereon.

According to a first aspect of such an embodiment, a complete splice can be made using one tool. As applied to ranching fence repair, the convenience of one tool operation directly leads to greater personal safety in that more time is spent with one or two hands free. The awkward conventional method with its attendant difficulty and exposure to injury is avoided.

According to another aspect, the tool allows the operator's muscles to efficiently cooperate when the tool is used to apply tension to the wire. The operator's hand grip maintains a secure grip on the wire in the jaws while the operator's arm muscles cooperate to rotate the spool in a winding motion against the wire. One hand operation of the tool is practical. Two hand operation involves simultaneous and symmetric use of the muscles in both hands and both arms for greater control, improved coordination, lower fatigue, and lower risk of personal injury. Because the wire is wound around the spool in a controlled fashion with less effort, greater tension can be achieved.

The present invention may be practiced according to a method for splicing a first wire end and a second wire end in one embodiment which includes the steps of forming a loop in the first wire end, passing the second wire end through the loop, gripping the second wire end between the jaws of a pair of pivoting handpiece, one handpiece having a spool, while winding the second wire end about the spool.

According to a first aspect of such a method, continuous gripping while winding prevents loss of control of the second wire end. A sudden loss of control of the second wire is avoided. Personal safety is increased. The average time spent making the splice is decreased. These and other embodiments, aspects advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

A person having ordinary skill in the art will recognize where portions of the figure have been expanded to improve the clarity of the presentation.

DETAILED DESCRIPTION OF THE INVENTION

Figure 1:
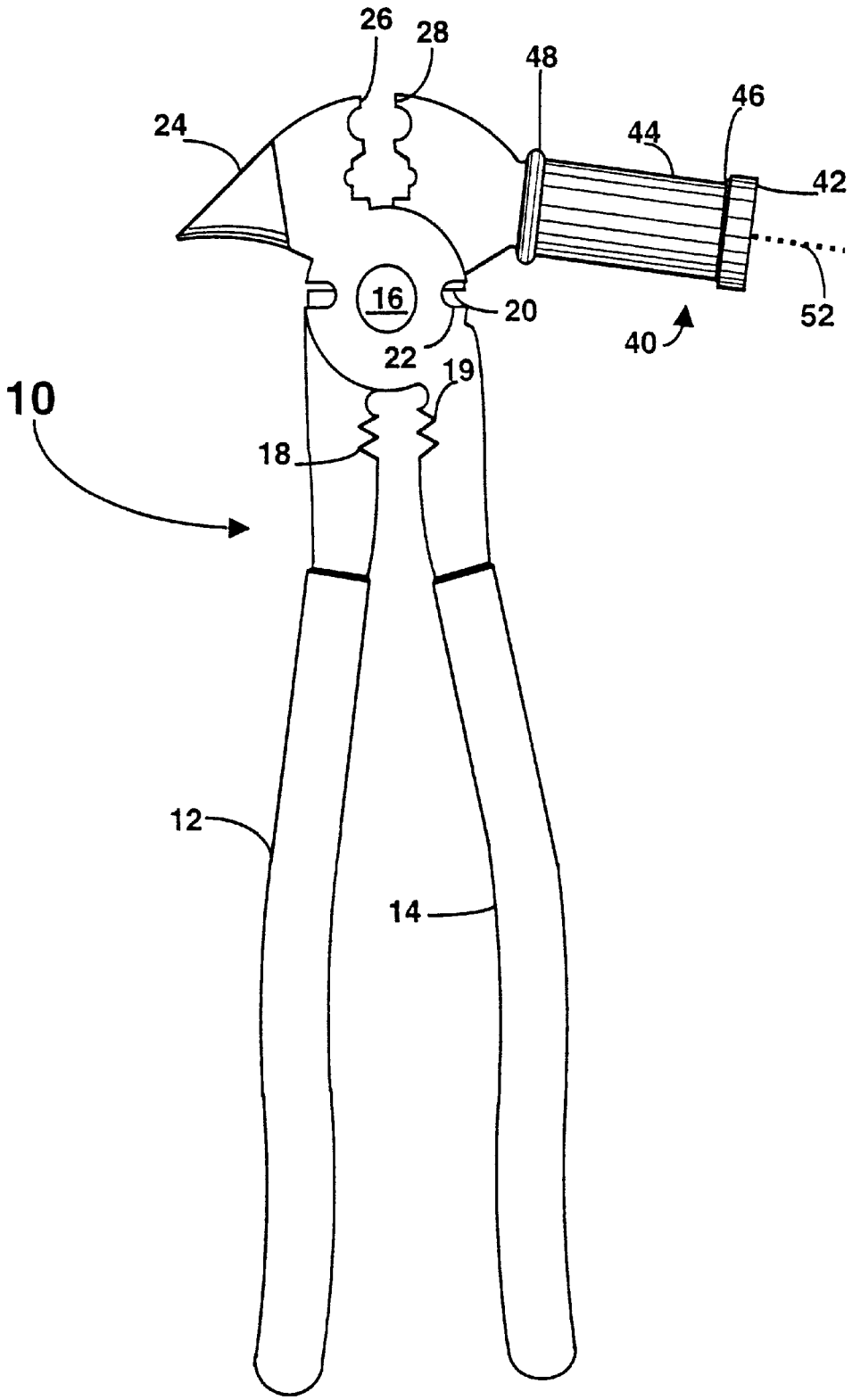
FIG. 1 is a side view of a hand tool in one embodiment of the present invention.

FIG. 1 is a side view of a hand tool in one embodiment of the present invention. Tool 10 includes handpiece 12 and handpiece 14, pivotally attached at hinge 16. Handpieces 12 and 14, in one embodiment are conventionally forged of tool steel alloy, then treated, sharpened, polished, and coated with hand grip material according to conventional tool building techniques. Handpiece 12 includes grip 18, cutting surface 20, jaw 28, and spool 40. Handpiece 14 includes grip 19, cutting surface 22, jaw 26 and anvil 24. Spool 40 is a solid steel cylinder welded to handpiece 12. Spool 40 includes cylindrical winding surface 44, hammer face 42 and shoulders 46 and 48, shoulder 46 being on the distal end of spool 40, and shoulder 48 being on the proximal end of spool 40, relative to jaw 28.

Handpieces 12 and 14 cooperate to perform multiple functions for manipulating wire. Grips 18 and 19 are opposing and cooperate to grip wire therebetween when handpieces 12 and 14 are squeezed together. Cutting surfaces 20 and 22 cooperate to sheer wire placed therebetween when handpieces 12 and 14 are squeezed together. By grasping both handpieces 12 and 14 in one hand, anvil 24 is used for prying and hammer face 42 is used for pounding. For manipulating wire fencing, pounding sets staples into a wooden post and prying removes them. A staple grasped between jaws 26 and 28 is removed without deforming the staple when the outer circumference of hammer face 42 is used as the leverage fulcrum.

Jaws 26 and 28 are opposing and cooperate to grip wire therebetween when handpieces 12 and 14 are squeezed together. As opposed to known techniques of laying the wire end in a V-shaped claw, or of placing the wire end under a spring loaded lever, the present invention provides superior control for safer, more accurate wire manipulation.

Conventional techniques are inadequate to maintain control for several reasons. Because conventional wire holding mechanisms are not adequate at all angles, failure to maintain hold occurs when the tool and wire are rotated for winding. At some angles and torques, the wire being held exhibits greater stiffness or greater spring capacity. In such situations, conventional techniques fail. In contrast, with hand tool 10, the user can apply appropriate forces to hand tool 10 for gripping and winding the wire without compromising safety or control. By increasing the safety of manipulating wire, larger diameter and stiffer wire can be manipulated quickly and safely.

The length of spool 40 is large enough to accomplish several functions with operator comfort and safety. For tool 10 to be effectively used as a hammer, hammer face 42 must be distant from handpiece 14 to avoid contact between the user's hand around handpiece 14 and the workpiece, such as a fence post. As spool 40 is made longer and of larger diameter, the weight and balance of tool 10 improves for use as a hammer because spool 40 is of solid, massive material and construction. In addition, an increased distance between jaw 28 and hammer face 42 improves leverage for removing staples as discussed above. Finally, the diameter and length of cylindrical surface 44 are sufficient for the anticipated slack wire to be wound thereon during tensioning and splicing operations. In one embodiment, the diameter and length of cylindrical surface 44 are 1.0 inch and 1.75 inch respectively. A length of 0.5 inches or less has been shown in range fencing repair to be too short to achieve the beneficial results described above.

A cross-section of the spool through surface 44 has a generally circular perimeter. In alternate and equivalent embodiments the cross-section is another regular polygon such as an octagon or hexagon. Such regular polygonal cross-sections contribute to lower manufacturing cost, though the circular cross-section of surface 44 is preferred for improved control during winding and unwinding wire on the spool. Other features of the present invention may be better understood by considering how the hand tool is used for splicing wire fencing.

Hand tool 10 is used in one method of the present invention to form a splice of the type illustrated in U.S. Pat. No. 5,400,835 to Badenoch et al. Badenoch and its cited references are hereby incorporated herein by reference for any purpose including description of known problems, conventional techniques, devices, materials, methods, and equivalents.

Figure 2:
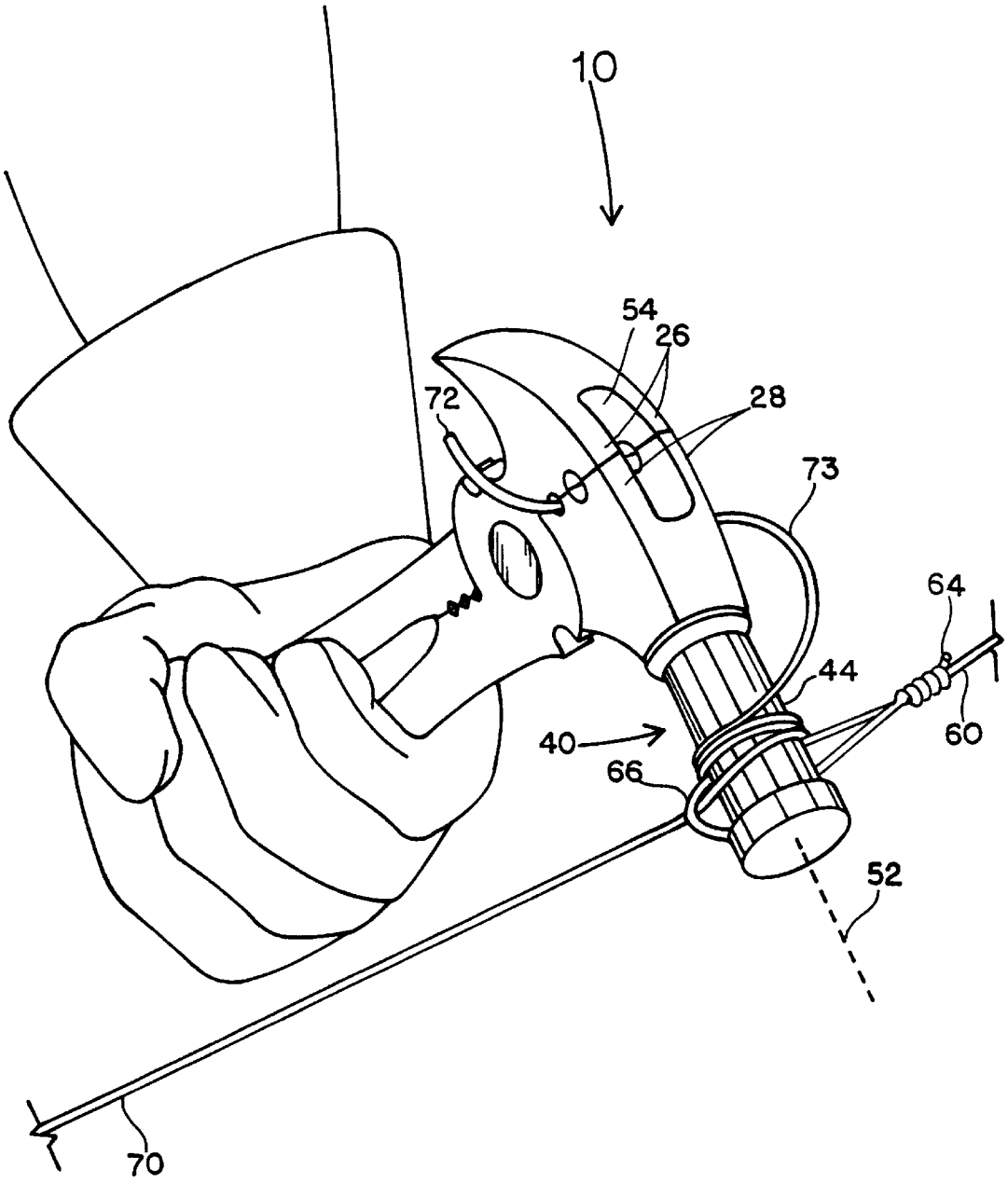
FIG. 2 is a view of the hand tool of FIG. 1 in use.

FIG. 2 is a view of hand tool 10 in use. A method of the present invention tensions and splices a first and a second wire end so that the resulting spliced wire is under considerable lengthwise tension. Consider the repair situation where the first wire extends toward and is attached to a first rigid support and the second wire extends toward and is attached to a second rigid support some distance away from the first support. To join the first wire end to the second wire end and achieve considerable lengthwise tension, proceed as follows with hand tool 10 as discussed above and with reference to FIG. 2:

1. With jaws 26 and 28, grasp first wire end 60 so that first wire 60 proceeds out of the top of hand tool 10. Bend first wire end 64 back on itself to form a first loop 66 having an opening of about one inch diameter prior to the wound termination of first loop 66 formed with first wire end 64.

2. Pass second wire end 72 through first loop 66.

3. As shown in FIG. 2, grasp second wire end 72 with jaws 26 and 28 so that second wire 70 proceeds out of one side of hand tool 10. Lay surface 44 on top of first loop 66, and wind second wire 70 around spool 40 while gripping second wire 70 in jaws 26 and 28. Continue winding until sufficient tension is established in the wires being joined.

4. Sharply pull spool 40 back along second wire 70 to kink second wire 70 where it touches first loop 66. Then, while gripping second wire 70 in jaws 26 and 28 and keeping second wire 70 back from first loop 66, unwind second wire 70 from spool 40.

5. Grasp second wire 70 at a point within about one inch of first loop 66 using jaws 26 and 28 with second wire 70 proceeding from side to side through hand tool 10. With a free hand, wind second wire end 72 around second wire 70 to form a second loop, completing the splice.

In the above method, second wire 70 gripped in jaws 26 and 28 is wound onto spool 40 between shoulders 46 and 48. Shoulders 46 and 48 extend radially outward from cylindrical surface 44 of spool 40, and have no notches for gripping the wire. By grasping second wire end 72 so that second wire 70 proceeds from the side of tool 10, second wire 70 forms a bend 73 of about 180 degrees to become tangent to surface 44 for the first winding. Stiff wire will resist manipulation, however, shoulders 46 and 48 confine windings onto a cylindrical surface. Because surface 44 is cylindrical having a straight line central axis 52, successive windings are uniformly and evenly laid in a neat, organized manner. Control of second wire 70 is greatly improved in contrast to attempting to form windings around a shape having a curved central axis or onto an uneven, tapered, or sloping surface.

In alternate embodiments of the foregoing method, the steps are performed in any practical sequence, including performing more than one step simultaneously. For example, in one operation, second wire end 72 is wound around second wire 70 as second wire 70 is unwound from spool 40.

Methods of the present invention apply equally to many types of wire including bare or insulated electrical wire, electric fencing wire, and barbed wire, to name a few examples. When splicing barbed wire, barbs are moved or removed from those portions being manipulated when a tighter splice is desired.

The foregoing description discusses preferred embodiments of the present invention, which may be changed or modified without departing from the scope of the present invention.

For example, in an alternate embodiment, one of several conventional latching mechanisms built into the handpieces is used to close jaws 26 and 28. An example of such a latching mechanism is of the type marketed under the tradename ViceGrips and includes a thumbscrew setting for determining the fixed relation between jaws 26 and 28 when the handpieces are squeezed to the closed position. In using such an embodiment, greater strength can be applied to winding wire onto spool 40 and greater tensions can be realized, though greater dexterity to set the closure distance and additional tool maintenance may be necessary.

In another alternate and equivalent embodiment, jaw 26 and jaw 28 are each formed with only one gripping surface so that groove 54 is omitted. Groove 54 provides space for handling barbed wire and for manipulating staples over wire. In still another alternate and equivalent embodiment, spool 40 and shoulder 48 are formed in a single casting operation with handpiece 12. These and other changes and modifications are intended to be included within the scope of the present invention.

While for the sake of clarity and ease of description, several specific embodiments of the invention have been described; the scope of the invention if intended to be measured by the claims as set forth below. The description is not intended to be exhaustive or to limit the invention to the form disclosed. Other embodiments of the invention will be apparent in light of the disclosure and in light of practice of the invention to one of ordinary skill in the art to which the invention applies.

What is claimed is:

1. A tool for tensioning a wire, the tool comprising:

a. a first handpiece comprising a first jaw; and b. a second handpiece, pivotally attached to the first handpiece, the second handpiece comprising:

(1) a second jaw that cooperates with the first jaw to grip the wire; and (2) a spool on which the wire is wrapped thereby tensioning the wire, said spool having a proximal end and a distal end, said spool having a shoulder on said proximal end and a shoulder on said distal end, both of said shoulders extending radially outward from said spool, and said shoulder on said distal end not having any notch.

2. The tool of claim 1 wherein the spool comprises a cylindrical surface on which the wire is wrapped.

3. The tool of claim 1 wherein the spool is characterized by a regular polygonal cross-section.

4. The tool of claim 1 wherein the spool comprises a hammer face.

5. The tool of claim 1 wherein the first jaw and the second jaw cooperate to grip the wire in a first position wherein the wire protrudes from the top of the tool and in a second position wherein the wire protrudes from the side of the tool.

* * * * *